US010045605B2

(12) United States Patent
Salvador-Zamora et al.

(10) Patent No.: US 10,045,605 B2
(45) Date of Patent: Aug. 14, 2018

(54) MULTI-USE SUPPORT FOR OUTDOOR ACTIVITIES

(71) Applicants: Marc Salvador-Zamora, Barcelona (ES); David DeSicart-Prieto, Barcelona (ES)

(72) Inventors: Marc Salvador-Zamora, Barcelona (ES); David DeSicart-Prieto, Barcelona (ES)

( * ) Notice: Subject to any disclaimer, the term of this patent is extended or adjusted under 35 U.S.C. 154(b) by 0 days.

(21) Appl. No.: 15/285,763

(22) Filed: Oct. 5, 2016

(65) Prior Publication Data

US 2017/0095064 A1 Apr. 6, 2017

(51) Int. Cl.
*A45F 3/44* (2006.01)
*A63B 71/02* (2006.01)
*A45F 3/00* (2006.01)

(52) U.S. Cl.
CPC ..... *A45F 3/44* (2013.01); *A63B 71/023* (2013.01); *A45F 2003/003* (2013.01)

(58) Field of Classification Search
CPC ..... A45F 3/44; A63B 71/023; E04H 15/62
USPC ..... 248/530, 85, 87, 156; 135/118; 56/329
See application file for complete search history.

(56) References Cited

U.S. PATENT DOCUMENTS 219,080 A * 9/1879 Edwards ..... A45F 5/10 248/512
619,585 A * 2/1899 Lerol ..... A01C 7/18 111/49
1,555,322 A * 9/1925 Kleinhesselink ..... E04H 15/62 135/118
2,059,921 A * 11/1936 Welss ..... A01K 97/10 248/175
3,195,898 A * 7/1965 Respini ..... A63B 63/00 135/118
3,568,455 A * 3/1971 McLaaughlin ..... E03F 3/06 138/105
3,669,390 A * 6/1972 Nielson ..... A01K 97/10 248/156
4,063,567 A * 12/1977 Martin ..... E04H 15/62 135/118
4,161,302 A * 7/1979 Stuhlman ..... E04D 13/08 239/275
4,440,370 A * 4/1984 Rood ..... A01G 25/00 248/75
4,479,628 A * 10/1984 Albright ..... A01K 97/10 248/156
4,938,446 A * 7/1990 Williams ..... A01K 97/10 248/530
5,242,247 A * 9/1993 Murphy ..... E02F 5/145 248/49
D342,016 S * 12/1993 Ziegelmann ..... D30/154
5,331,764 A * 7/1994 Sun ..... A01G 17/06 248/156
D359,793 S * 6/1995 Medlin, Jr. ..... D22/147
5,437,424 A * 8/1995 Netz, Sr. ..... F16L 3/00 248/49
D363,530 S * 10/1995 Dailey ..... D22/147
5,579,798 A * 12/1996 Pruitt ..... E04H 15/62 135/118

(Continued)

*Primary Examiner* — Eret C McNichols
(74) *Attorney, Agent, or Firm* — Luis Figarella

(57) ABSTRACT

The present invention, as described in the attached document, refers to a support allowing different uses as support for outdoor activities, depending on the activity, position and the tools or accessories that of support.

4 Claims, 2 Drawing Sheets

(56) References Cited

U.S. PATENT DOCUMENTS 5,667,174 A * 9/1997 Adams ..... A45F 3/44 248/156
5,848,522 A * 12/1998 Coviello, Jr. ..... A01D 46/26 47/32.4
6,490,823 B1 * 12/2002 Ibarra ..... A01K 97/10 248/512
6,527,246 B1 * 3/2003 Stinnett ..... F16L 1/06 248/530
6,568,122 B1 * 5/2003 Smith ..... A01K 97/10 248/530
6,578,568 B1 * 6/2003 Dufort ..... F24B 1/205 126/25 A
6,691,973 B1 * 2/2004 Barfield ..... A01K 97/10 248/156
6,732,985 B1 * 5/2004 Cantrell ..... A45F 3/44 248/125.1
6,736,358 B2 * 5/2004 Johnson ..... A45F 3/44 248/125.3
6,938,384 B1 * 9/2005 Hodge ..... E04H 15/62 135/118
6,997,199 B1 * 2/2006 Wright ..... E04H 15/62 135/118
7,037,221 B2 * 5/2006 Bouffard ..... A63B 69/0097 248/156
7,159,256 B1 * 1/2007 Licari ..... E04H 15/003 135/118
7,213,362 B1 * 5/2007 Weber ..... A01K 97/10 248/530
7,235,022 B2 * 6/2007 Pepe ..... A63L 355/10 248/156
7,318,266 B2 * 1/2008 Bergh ..... A45F 3/44 248/156
7,520,485 B1 * 4/2009 Giannetto ..... A01K 97/10 173/91
7,937,883 B2 * 5/2011 Roemer ..... A01K 97/08 248/512
8,201,794 B1 * 6/2012 Pesola ..... A45F 3/44 248/311.2
D680,618 S * 4/2013 Hoover ..... D23/217
8,561,951 B2 * 10/2013 Wills ..... A01G 25/00 248/71
D723,356 S * 3/2015 Simon ..... D8/373
D738,190 S * 9/2015 Davtian ..... D6/608
9,187,925 B2 * 11/2015 Esarey ..... E04H 15/62
2003/0234334 A1 * 12/2003 Kenney ..... E04H 15/62 248/530
2005/0217188 A1 * 10/2005 Burns ..... E04H 15/62 52/157
2006/0097124 A1 * 5/2006 Kenney ..... A63C 19/062 248/530
2006/0241647 A1 * 10/2006 Chen ..... E04H 17/263 606/100
2007/0007425 A1 * 1/2007 Perotti ..... A45F 3/44 248/530
2009/0278020 A1 * 11/2009 Marcil ..... A45F 3/44 248/545
2010/0005701 A1 * 1/2010 Santiago ..... A01K 97/10 43/21.2
2010/0123067 A1 * 5/2010 Cardenas ..... F41B 5/06 248/530
2013/0227782 A1 * 9/2013 Marks ..... A47G 9/062 5/417
2014/0146526 A1 * 5/2014 Evans, Sr. ..... A45F 3/44 362/154
2015/0330097 A1 * 11/2015 Drummond ..... E04H 15/62 135/121
2015/0376912 A1 * 12/2015 Livacich ..... E04H 15/44 135/127
2016/0032612 A1 * 2/2016 Huang ..... E04H 15/10 362/120
2016/0044906 A1 * 2/2016 Simms, Sr. ..... A01K 97/10 43/21.2
2017/0051527 A1 * 2/2017 Dawson ..... E04H 15/62

* cited by examiner

MULTI-USE SUPPORT FOR OUTDOOR ACTIVITIES

OBJECT OF THE INVENTION

The invention, as stated in the title of this descriptive report, involves a support that permits different uses, depending on the outdoor activity being performed, its position and the tools or accessories it holds.

The object of the invention is a multipurpose support with different functions or uses which, once embedded in the ground in the position chosen by the user, can be used as a bottle opener, a holder or support for lunch boxes, trays or similar items, a holder for adventure or similar knives, or as a holder for fishing rods, roasting or similar rods, thereby avoiding having to hold these items in your hands or placing them directly on the ground. It can also be used in combination with three or more supports as structural masts for an optional textile sheet which, once tightened, creates a flat textile surface off the ground in the form of a table.

BACKGROUND OF THE INVENTION

There are a number of supports or stakes for different uses, mainly, plastic or metal, known to the state of the art, all of which have a common denominator, namely that they are designed to hold different elements, they must be driven or embedded in the ground and they have only been designed for a single function or use. It should be noted that the holder for beverages or similar items, although designed to hold bottles, containers or packages, is not a multipurpose support, since its only function is to hold objects on top of its receptacle or flat support surface. Apart from that, in the group of plastic stakes or supports, we find devices to hold beach umbrellas, rods or bars, devices for supporting textile sheets or tarpaulins on soft surfaces, for example towels, as well as fishing rod holders and other types of stakes intended mainly for horticultural use, such as supports for hydroponic crops. In the group of metallic stakes or supports, we find devices such as pegs and stakes to secure tents or, for example, stakes for securing loads in construction.

In all of these, the main objective is to secure, retain or tighten different elements or tools, taking advantage of the force exerted by the land or ground into which the support or stake is driven or embedded. That is, they are based on the physical principle of force of friction exercised by the land on a body inserted into it. These are the forces that offer resistance to those that need to be counteracted, making it possible to secure, retain or tighten these elements or tools.

These types of supports or stakes only fulfill the function of facilitating the securing, retention or tightening of the different elements when they are driven or embedded in the ground. Consequently, they cease to be of use when they are not inserted into the ground and, moreover, they are not designed to have more than one use or function.

In contrast, when sustaining or placing different tools or accessories on a support or stake driven or embedded in the ground to keep them off the ground, we are not aiming to secure these items to the ground. Their use or functionality does not depend on the resistance offered by the ground in relation to the support or stake. By way of example, some of its possible functions, such as the bottle opener, can be used without the support or stake being driven or embedded in the ground. Therefore, it can be considered that people engaging in outdoor activities, such as hiking, fishing, camping or going to the beach, do not have a multipurpose device available to help them hold or support different tools or accessories in a single product, while keeping them off the ground, or to optionally to create flat and clean textile surfaces in the form of a table, regardless of the orography of the terrain where they are situated.

Generally, this support is used in leisure or sports activities in a natural setting and commonly by adults when preparing meals or snacks or while resting. On these occasions, with the arrival of good weather, its use can be extended to urban areas such as parks and gardens, as it only requires a piece of land where the device can be inserted.

On these occasions, with the invention that is described below, users have a support to hold and keep tools off the ground during their outdoor activities.

DESCRIPTION OF THE INVENTION

This invention resolves the technical problem posed by means of a support which, on the one hand, holds tools and accessories relating to outdoor activities and, on the other, keeps them off the ground, placed either directly on the support or directly on the textile table. In this way, the element acts as a support that makes it unnecessary for users to hold the tools or accessories in their hands during their activities, which they can now carry out in a way that is more hygienic, clean and practical.

The support is formed by a single object with two clearly differentiated ends. The first, or bottom end, which finishes in a point, with a preferably cylindrical section, is the part that makes it possible to drive or embed it in the ground.

The second, or top end, preferably finished in the shape of a Y and preferably with a cylindrical section, is the part that makes it possible for the user to hold the support, adopting the function of handle and enabling sufficient force to be exerted in order to insert the support in the ground.

This is also where the different slots specifically designed to support the various tools and accessories, bottle opener and slot for securing the textile table are located.

The parts that make up the support can be manufactured as a single piece, comprising a single object, or they can be manufactured separately, forming a set of two or more pieces that will need to be assembled before and after use.

Optionally, the support can be combined with a triangular or rectangular textile cloth which, when tightened and secured at each end to a support, forms a textile surface that acts like a table, allowing the user to have a flat and ample surface, away from the ground, in situations or locations where it may be difficult to find a similar natural surface.

Depending on the outdoor activity or the user profile for who it is intended, the support that is the object of this invention can take on different shapes, without this altering its use.

DESCRIPTION OF THE DRAWINGS

As a supplement to this descriptive report, and for the purpose of providing a better understanding of the invention's features based on an example of its preferred practical use, this description also contains, as an integral part of it, a series of drawings, which are illustrative but not all-inclusive, and which depict the following.

DESCRIPTION OF AN EXAMPLE OF USE OF THE INVENTION

Figure 1:
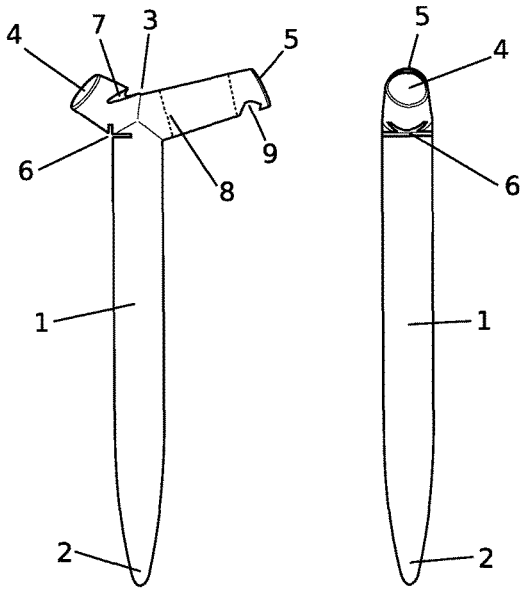
FIG. 1.—Front elevation view of the invention, giving an example of use of the multipurpose support for outdoor activities.
Figure 2:
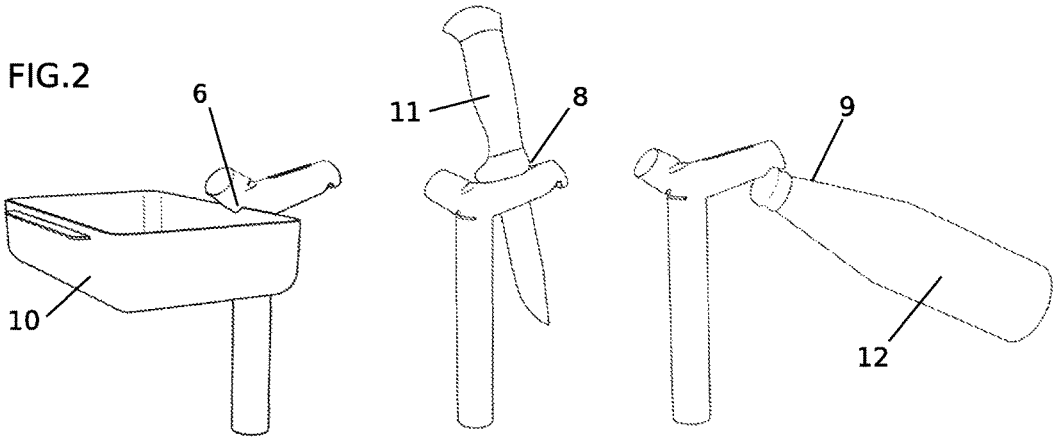
FIG. 2.—Perspective view of the invention, giving an example of use of the multipurpose support for outdoor activities, embedded in the ground, acting as a lunch box holder, a knife holder and a bottle opener.
Figure 3:
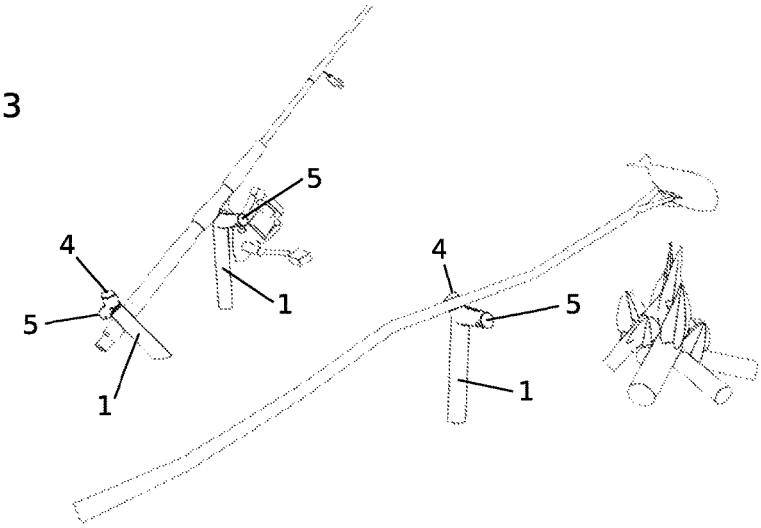
FIG. 3.—Perspective view of the invention, giving an example of use of the multipurpose support for outdoor activities, embedded in the ground, acting as a fishing rod holder and roasting stick holder.
Figure 4:
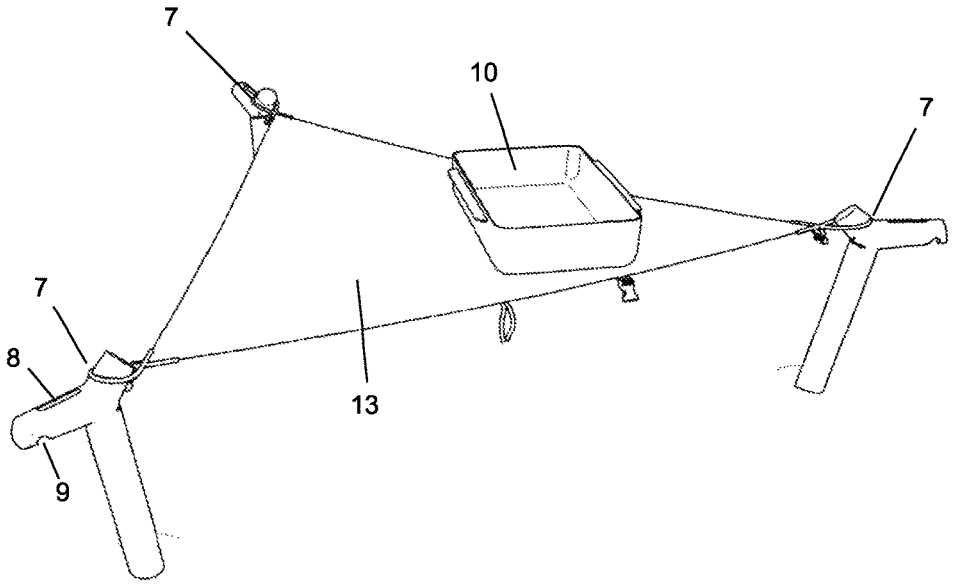
FIG. 4.—Perspective view of the invention, giving an example of use of the multipurpose support for outdoor activities, embedded in the ground, with the optional textile sheet acting as a textile table.

In view of the above figures, and in accordance with the numbering, they show an example of the preferred but not exclusive use of the multipurpose support for outdoor activities, consisting of the parts or elements indicated and described below, by way of a detailed description of the preferred use of the invention.

The multipurpose support for outdoor activities in this example features a main body (1) made of a suitably resistant plastic, usually a cylindrical section, although this does not pose a limitation, a bottom pointed end (2) that enables it to be embedded in the ground, usually having a cylindrical section, although this does not pose a limitation, and a top end with two arms in the shape of a Y acting as a handle (3), usually with a cylindrical section, although this does not pose a limitation, which are an extension of the material comprising the body (1).

In this way, with a single one-piece injected plastic body, the basic structure of the support is obtained.

The top end (3), has a short arm (4), the intersections of which with the main body (1) are located in the bottom part, as well as a slot for holding the lunch box (6) and, in the top part, a slot for securing the tensioner for the optional textile table (7). In the long arm (5) of the top end (3), running along it, there is a through and through slit for the knife (8) and, in the bottom part, the bottle opener (9).

In this way, the lunch box (10), knife (11), bottle (12) and textile table (13) constitute, by way of example, the various tools or accessories for outdoor activities, which can be combined all together or at random, further reinforcing the multipurpose nature of the support.

It is not considered necessary to provide a broader explanation to any person skilled in the art in order for them to understand the scope of the invention and the benefits derived from it, seeing that the nature of this invention, along with its manner of implementation, have been described in a sufficient manner and it is hereby stated that, when so required, it may be implemented in other embodiments which differ from that indicated for illustrative purposes, which will provide the same level of protection, provided its fundamental principle is not altered, changed or modified.

The invention claimed is:

1. A picnic gear support for outdoor meals comprising; an elongated and protuberance free cylindrical main body with a pointed distal end for embedding said distal end in the ground; and a near end having two cylindrical extensions, wherein one said extension is comprised of a first short arm having a distal end and a bottom portion and a second said extension is comprised of a second long arm having a distal end and a bottom portion, so that the combination upper continuous surface of said extensions acts as a grip handle, wherein said support has a tray or food container support feature that is comprised of two outward facing slots, a first downward facing slot having a first slot opening located at the bottom portion of said first arm, and a second outward facing slot having a second slot opening located on said cylindrical main body near said first slot such that said first and second slot openings are positioned adjacently and form a support feature opening.

2. The picnic gear support for outdoor meals of claim 1, wherein;

said second long arm's bottom portion includes a bottle opener slot at said second arm's distal end and a slit through said second arm to act as a knife holder.

3. The picnic gear support for outdoor meals of claim 2 wherein;

said first short and second long arms intersect at said main body near end at a Y angle that is less than 180 degrees.

4. The picnic gear support for outdoor meals of claim 1 wherein;

said first short and second long arms intersect at said main body near end at a Y angle that is less than 180 degrees.

* * * * *